US005857480A

United States Patent [19]

Klein

[11] Patent Number: 5,857,480

[45] Date of Patent: Jan. 12, 1999

[54] WATER PURGING SYSTEM

[76] Inventor: Jerry Klein, 637 5th St., Ouray, Colo. 81427

[21] Appl. No.: 938,796

[22] Filed: Sep. 26, 1997

[51] Int. Cl.[6] ..... B08B 9/06; F04B 17/00

[52] U.S. Cl. ..... 137/209; 137/240; 137/565; 138/32; 138/35; 222/148; 239/106; 417/405

[58] Field of Search ..... 15/104.061; 134/166 C; 62/303; 137/59, 61, 209, 240, 301, 302, 565; 222/148; 239/106; 417/375, 405

[56] References Cited

U.S. PATENT DOCUMENTS

| | | | |
|---|---|---|---|
| 610,790 | 9/1898 | Beckers | 417/405 |
| 828,597 | 8/1906 | Cowles | 138/32 |
| 1,720,326 | 7/1929 | Halstead et al. | 417/405 |
| 1,798,646 | 3/1931 | Andersson | 417/405 |
| 2,635,621 | 4/1953 | Hansen | 137/301 |
| 2,707,967 | 5/1955 | Adams | 137/301 |
| 3,534,762 | 10/1970 | Noland | 137/209 |
| 3,845,779 | 11/1974 | Greene, Jr. | 137/209 |
| 3,977,815 | 8/1976 | Stull | 417/405 |
| 4,246,926 | 1/1981 | Morello | 137/240 |
| 4,809,732 | 3/1989 | Buehler | 137/209 |
| 4,986,311 | 1/1991 | Mikkelson | 138/32 |
| 5,095,899 | 3/1992 | Green | 128/204.18 |
| 5,433,246 | 7/1995 | Horton | 137/209 |
| 5,603,228 | 2/1997 | Barthold et al. | 137/240 |
| 5,715,869 | 2/1998 | Patterson | 138/35 |

*Primary Examiner*—George L. Walton

[57] ABSTRACT

A water purging system is disclosed. The system includes a primary water line having a first end with threads for the receipt of a faucet constituting a source of water and a second end with threads for coupling to a supplemental water line adapted to be purged of water after usage. An air tank is provided for the receipt of compressed air and for expelling the compressed air into the primary line and supplemental line after use of the system. The secondary line has a first end coupled with the air tank and a second end coupled to a central extent of the primary line. The secondary line also has a one-way check valve therein for the flow of air from the air tank to the primary and supplemental lines. Further included is a turbine having a first end operatively coupled to the air tank and having a second end operatively coupled to the primary line. The turbine includes a housing having a cylindrical bore with an air piston reciprocally mounted therein, the turbines having water turbine vanes in the primary line adapted for rotation upon the flow of water therepast with a linkage coupling the turbine vanes and the air piston to reciprocate the air piston upon rotation of the vanes for generating pressurized air for movement to the air tank.

4 Claims, 3 Drawing Sheets

Fig. 1
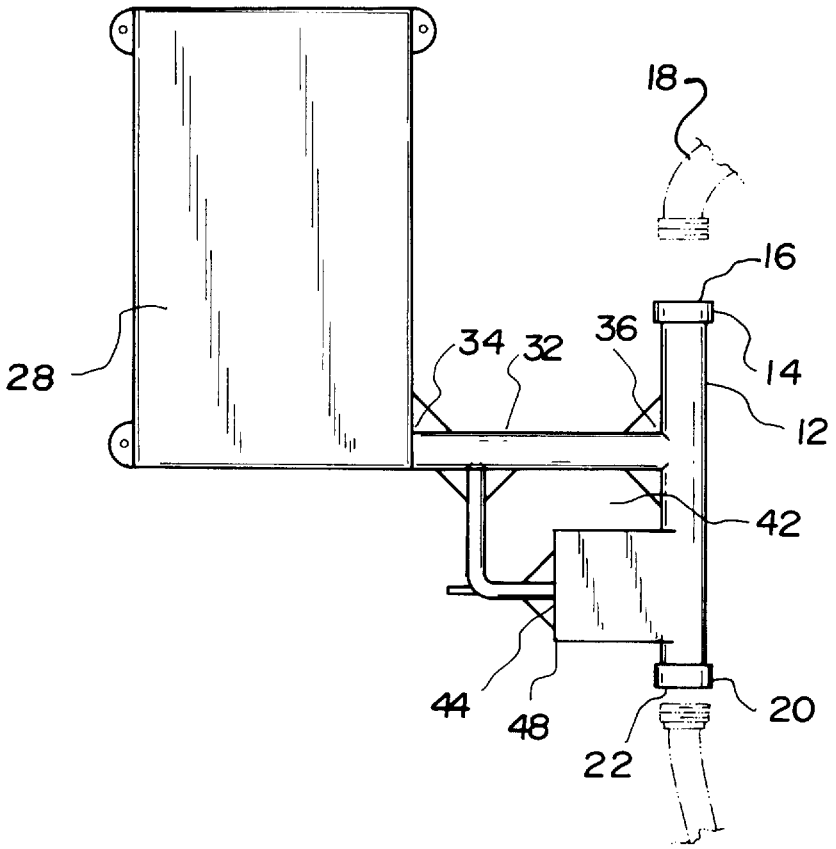
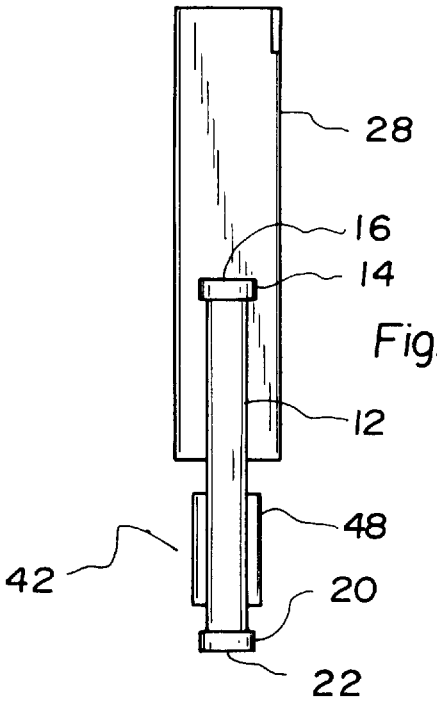
Fig. 2

38
32

52
48
56
42
12
5
5
60
54
44
46
58
50

WATER PURGING SYSTEM

BACKGROUND OF THE INVENTION

1. Field of the Invention

The present invention relates to a new and improved water purging system and, more particularly, pertains to building up air pressure when water flows under air pressure to purge water out of a hose or sprinkler system or the like after usage to keep it from freezing.

2. Description of the Prior Art

The use of water handling systems of various designs and configurations is known in the prior art. More specifically, water handling systems of various designs and configurations heretofore devised and utilized for the purpose of handling water and preventing the freezing of water lines are known to consist basically of familiar, expected, and obvious structural configurations, notwithstanding the myriad of designs encompassed by the crowded prior art which has been developed for the fulfillment of countless objectives and requirements.

The prior art discloses a large number of water handling systems of various designs and configurations. By way of example, U.S. Pat. No. 3,845,779 issued Nov. 5, 1974 to Greene, Jr. discloses a garden hose evacuating device.

U.S. Pat. No. 4,022,244 issued May 10, 1977 to Oman discloses an irrigation purge valve.

U.S. Pat. No. 4,246,926 issued Jan. 27, 1981 to Morello discloses an apparatus for removing residual water from a water system.

U.S. Pat. No. 4,272,021 issued Jun. 9, 1981 to Standal discloses a pipeline drain apparatus.

U.S. Pat. No. 4,326,589 issued Apr. 27, 1982 to Ballman discloses an anti-freeze arrangement for sprinkler systems.

U.S. Pat. No. 4,355,652 issued Oct. 26, 1982 to Perkins discloses a liquid purging device.

U.S. Pat. No. 4,497,334 issued Feb. 5, 1985 to Wolf et al. discloses a cleaning apparatus for liquid delivery systems.

U.S. Pat. No. 4,735,225 issued Apr. 5, 1988 to Huveteau discloses a method and apparatus for drawing and regulating the output and pressure of a liquid additive.

U.S. Pat. No. 4,768,537 issued Sep. 6, 1988 to Tash discloses an air hose to water hose adapter and connector.

U.S. Pat. No. 4,809,732 issued Mar. 7, 1989 to Buehler discloses a fitting for clearing water from fluid containing systems.

U.S. Pat. No. 4,848,389 issued Jul. 18, 1989 to Pirkle discloses a freeze protection device.

U.S. Pat. No. 4,958,659 issued Sep. 25, 1990 to Dowdall discloses a pressuring and purging apparatus.

U.S. Pat. No. 5,095,899 issued Mar. 17, 1992 to Green discloses an air delivery system.

U.S. Pat. No. 5,220,937 issued Jun. 22, 1993 to Roberts et al. discloses a freeze buster.

U.S. Pat. No. 5,425,390 issued Jun. 20, 1995 to Carson discloses a purging method.

In this respect, the water purging system according to the present invention substantially departs from the conventional concepts and designs of the prior art, and in doing so provides an apparatus primarily developed for the purpose of building up air pressure when water flows under air pressure to purge water out of a hose or sprinkler system or the like to keep it from freezing.

Therefore, it can be appreciated that there exists a continuing need for a new and improved water purging system which can be used for building up air pressure when water flows under air pressure to purge water out of a hose or sprinkler system or the like to keep it from freezing. In this regard, the present invention substantially fulfills this need.

SUMMARY OF THE INVENTION

In view of the foregoing disadvantages inherent in the known types of water handling systems of various designs and configurations now present in the prior art, the present invention provides a new and improved water purging system. As such, the general purpose of the present invention, which will be described subsequently in greater detail, is to provide a new and improved water purging system and methods which have all the advantages of the prior art and none of the disadvantages.

To attain this, the present invention essentially comprises a new and improved water purging system comprising, in combination, a primary water line having a first end with threads for the receipt of a faucet constituting a source of water and having a second end with threads for coupling to a supplemental water line adapted to be purged of water after usage; an air tank for the receipt of compressed air when the system is in use and for expelling the compressed air into the primary line and supplemental line after use of the system; a secondary line having a first end coupled with the air tank and a second end coupled to a central extent of the primary line, the secondary line having a one-way check valve therein for the flow of air from the air tank to the primary and supplemental lines; and a turbine having a first end operatively coupled to the air tank and having a second end operatively coupled to the primary line, the turbine including a housing having a cylindrical bore with an air piston reciprocally mounted therein, the turbines having water turbine vanes in the primary line adapted for rotation upon the flow of water therepast with a linkage coupling the turbine vanes and the air piston to reciprocate the air piston upon rotation of the turbine vanes for generating pressurized air for movement to the air tank, the turbine also having a one-way air valve thereadjacent to preclude the return of compressed air from the air tank to the air turbine, the air turbine also including an air intake valve coupled with respect to the bore on the side thereof remote from the turbine blades for adding compressed air to the air tank.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water purging system which has all the advantages of the prior art water handling systems of various designs and configurations and none of the disadvantages.

It is another object of the present invention to provide a new and improved water purging system which may be easily and efficiently manufactured and marketed.

It is a further object of the present invention to provide a new and improved water purging system which is of a durable and reliable construction.

An even further object of the present invention is to provide a new and improved water purging system which is susceptible of a low cost of manufacture with regard to both materials and labor, and which accordingly is then susceptible of low prices of sale to the consuming public, thereby making such a water purging system economically available to the buying public.

Even still another object of the present invention is to build up air pressure when water flows under air pressure to purge water out of a hose or sprinkler system or the like to keep it from freezing.

Lastly, it is an object of the present invention to provide a water purging system. The system includes a primary water line having a first end with threads for the receipt of a faucet constituting a source of water and a second end with threads for coupling to a supplemental water line adapted to be purged of water after usage. An air tank is provided for the receipt of compressed air and for expelling the compressed air into the primary line and supplemental line after use of the system. The secondary line has a first end coupled with the air tank and a second end coupled to a central extent of the primary line. The secondary line also has a one-way check valve therein for the flow of air from the air tank to the primary and supplemental lines. Further included is a turbine having a first end operatively coupled to the air tank and having a second end operatively coupled to the primary line. The turbine includes a housing having a cylindrical bore with an air piston reciprocally mounted therein, the turbines having water turbine vanes in the primary line adapted for rotation upon the flow of water therepast with a linkage coupling the turbine vanes and the air piston to reciprocate the air piston upon rotation of the vanes for generating pressurized air for movement to the air tank.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the new and improved water purging system constructed in accordance with the principles of the present invention.

FIG. 2 is a side elevational view of the system shown in FIG. 1.

The same reference numerals refer to the same parts throughout the various Figures.

DESCRIPTION OF THE PREFERRED EMBODIMENT

Figure 3:
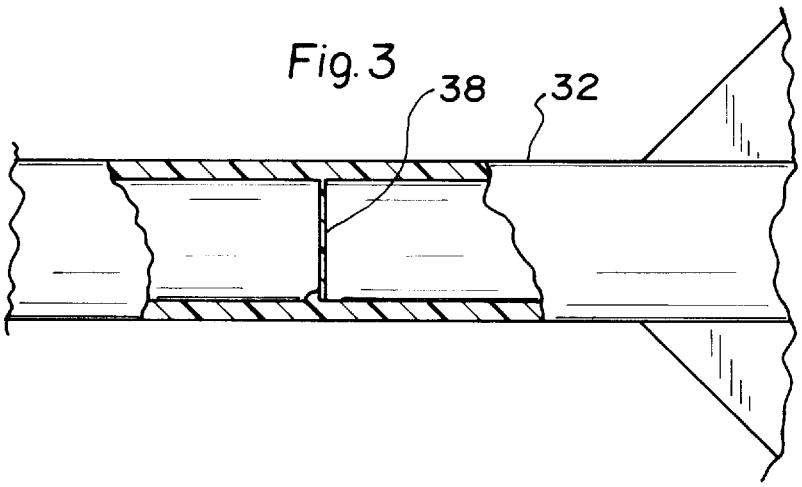
FIG. 3 is a side elevational view partly in cross section showing the one-way check valve in the secondary line.
Figure 4:
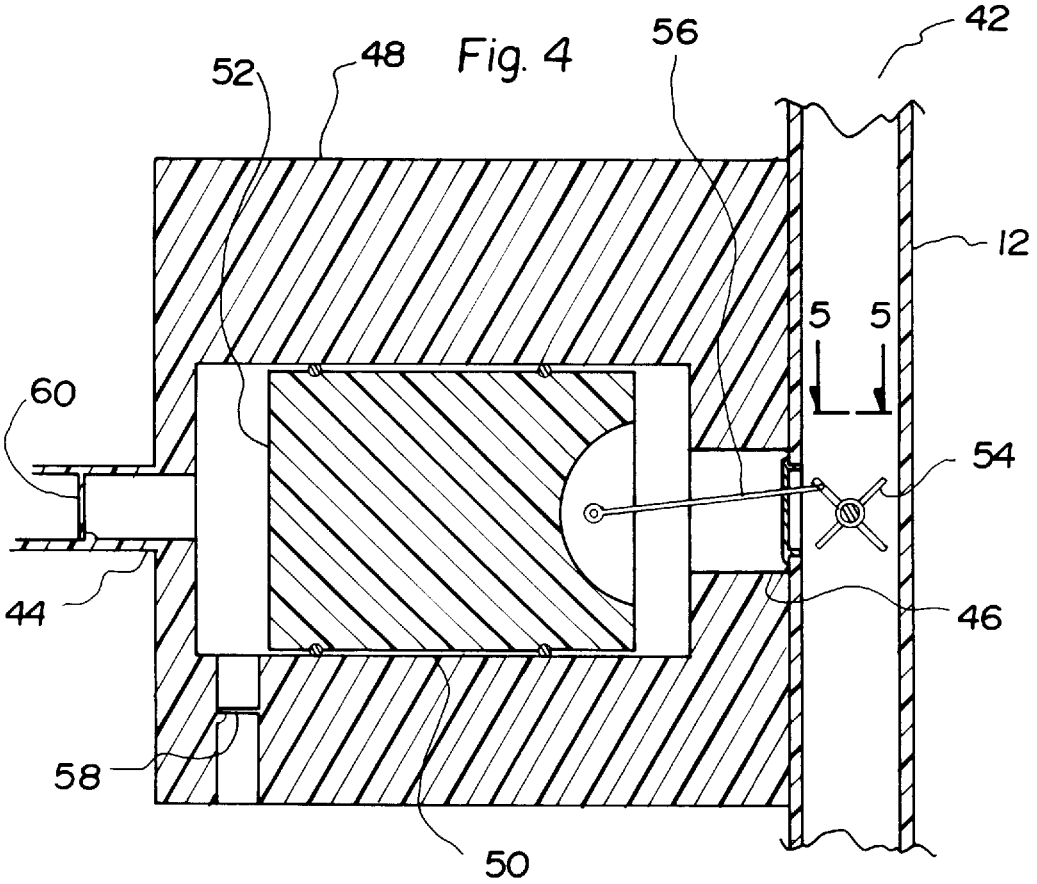
FIG. 4 is a cross-sectional view of the turbine illustrated in FIGS. 1 and 2.
Figure 5:
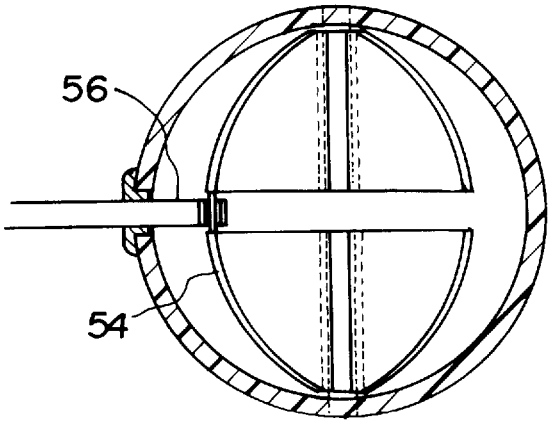
FIG. 5 is a plan view partly in cross section of the turbine vanes shown in FIG. 4 taken along line 5—5 of FIG. 4.
Figure 6:
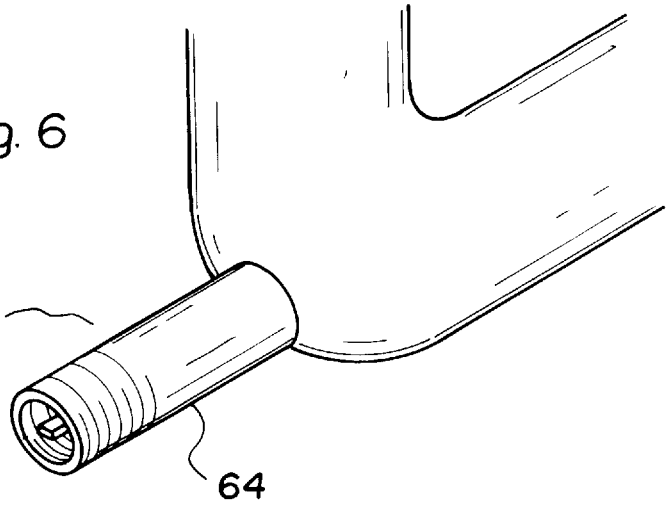
FIG. 6 is a perspective illustration of the exterior end of the auxiliary air valve.

With reference now to the drawings, and in particular to FIGS. 1 through 6 thereof, the preferred embodiment of the new and improved water purging system embodying the principles and concepts of the present invention and generally designated by the reference numeral 10 will be described.

The present invention, the new and improved water purging system, is a system 10 comprised of a plurality of components. Such components, in their broadest context, include a primary water line, an air tank, a secondary line, and a turbine. Each of the individual components is specifically configured and correlated one with respect to the other so as to attain the desired objectives.

The system 10 of the present invention, the improved water purging system, includes as a primary component the primary water line 12. Such primary water line has a first end 14 with threads 16. Such threads are for the receipt and releasable coupling of a faucet 18. The faucet is part of the house or other structure with which the present invention is to be utilized. The faucet constitutes a source of water for use in association with the present invention. The primary water line also has a second end 20 with threads 22. Such threads are for coupling to a supplemental water line 24. The supplemental water line may be a hose, sprinkler system or the like. The supplemental water line is adapted to be purged of water after usage. The purpose of the purging of the water from the supplemental water line is to preclude any freezing which might occur after usage when water might be retained within the supplemental water line and the temperature should drop.

Next provided as a component of the system 10 is an air tank 28. The air tank is for the receipt of compressed air. The compressed air is provided to the air tank when the system is in use. The air tank functions to expel the compressed air from the tank into the primary line and supplemental line after usage of the system to effect the desired purging.

A secondary line 32 is also provided. The secondary line has a first end 34. Such first end is operatively coupled with the air tank. The secondary line has a second end 36 operatively coupled to a central extent of the primary line. Located within the secondary line is a one-way check valve 38. The check valve is constructed and configured to allow for the flow of air from the air tank to the supplemental and primary lines for the purging function.

Next provided as a primary component of the system 10 is a turbine 42. The turbine has a first end 44 operatively coupled to the air tank. The turbine also has a second end 46 operatively coupled to the primary line. The turbine includes a housing 48. The housing is formed to have a cylindrical bore 50 with a correspondingly configured cylindrical air piston 52. The air piston is reciprocally mounted within the bore. In addition, the turbine includes water turbine vanes 54, preferably four in number. The vanes are located in the primary line. They are mounted on an axis within the primary line for rotation about an axis perpendicular to the intended flow of water through the primary line. In addition, a linkage 56 couples one of the turbine vanes to the air piston to effect the reciprocation of the air piston upon rotation of the turbine vanes as caused by the flow of water therepast. This action generates pressurized air on the side of the piston remote from the vanes from one way valve 58. The pressurized air is adapted for movement to the air tank to build up a supply of pressurized air for use in purging the tank as will be readily understood.

The turbine also has a one-way air valve 60 thereadjacent. Such one-way air valve is between the reciprocating piston and the air tank and functions to preclude the return of compressed air from the air tank to the air turbine. In addition, the air turbine also includes an air intake valve 62 in the line 64 coupling the turbine and the tank. Such air intake valve is for adding compressed air to the air tank at times when water is not flowing through the primary line to rotate the vanes. This device builds up air pressure when water flows under pressure to purge the water out of the hose or sprinkler system or the like. This is to keep the water from freezing in the hose or sprinkler system for increased safety.

Note is also taken that the turbine in the primary line could have, in association with that, a water bypass built into it for additional flow when the pressure within the tank reaches or approaches a certain maximum limit. Such is for additional safety purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved water purging system comprising, in combination:

a primary water line having a first end with threads for the receipt of a faucet constituting a source of water and having a second end with threads for coupling to a supplemental water line for communicating a flow of water to a water utilization device;

an air tank for the receipt of compressed air when the system is in use and for expelling the compressed air into the primary line and supplemental line to purge the primary and supplemental lines of any water disposed therein after the water flow has been terminated;

a secondary line having a first end coupled with the air tank and a second end coupled to a central extent of the primary line, the secondary line having a one-way check valve therein for the flow of air from the air tank to the primary and supplemental lines; and a turbine having a first end operatively coupled to the air tank and having a second end operatively coupled to the primary line, the turbine including a housing having a cylindrical bore with an air piston reciprocally mounted therein, the turbine having water turbine vanes in the primary line adapted for rotation upon the flow of water therepast with a linkage coupling the turbine vanes and the air piston to reciprocate the air piston upon rotation of the turbine vanes for generating pressurized air for movement to the air tank, the turbine also having a one-way air valve to preclude the return of compressed air from the air tank to the turbine, the turbine also including an air intake valve coupled with respect to the bore on the side thereof remote from the turbine blades for adding compressed air to the air tank.

2. A water purging system comprising:

a primary water line having a first end with threads for the receipt of a faucet constituting a source of water and having a second end with threads for coupling to a supplemental water line for communicating a flow of water to a water utilization device;

an air tank for the receipt of compressed air and for expelling the compressed air into the primary line and supplemental line to purge the primary and supplemental lines of any water disposed therein after the water flow has been terminated;

a secondary line having a first end coupled with the air tank and a second end coupled to a central extent of the primary line, the secondary line having a one-way check valve therein for the flow of air from the air tank to the primary and supplemental lines; and a turbine having a first end operatively coupled to the air tank and having a second end operatively coupled to the primary line, the turbine including a housing having a cylindrical bore with an air piston reciprocally mounted therein, the turbine having water turbine vanes in the primary line adapted for rotation upon the flow of water therepast with a linkage coupling the turbine vanes and the air piston to reciprocate the air piston upon rotation of the vanes for generating pressurized air for movement to the air tank turbine also having a one-way air valve to preclude the return of compressed air from the air tank to the turbine.

3. The system as set forth in claim 2 and further including:

a one-way air valve between the air tank and turbine to preclude the return of compressed air from the air tank to the air turbine.

4. The system as set forth in claim 2 and further including:

a supplemental air intake valve coupled with respect to the bore on the side thereof remote from the turbine blades.

* * * * *